US005595853A

United States Patent [19]

Ono et al.

[11] Patent Number: 5,595,853

[45] Date of Patent: Jan. 21, 1997

[54] OPTICAL IMAGE FORMING MATERIAL

[75] Inventors: Makoto Ono; Naoto Yanagihara, both of Shizuoka, Japan

[73] Assignee: Fuji Photo Film Co., Ltd., Kanagawa, Japan

[21] Appl. No.: 528,010

[22] Filed: Sep. 14, 1995

[30] Foreign Application Priority Data

Oct. 14, 1994 [JP] Japan ..... 6-249112

[51] Int. Cl.[6] ..... G03C 1/675

[52] U.S. Cl. ..... 430/138; 503/225; 503/226; 503/216; 430/337; 430/338; 430/350; 430/348

[58] Field of Search ..... 503/200, 216, 503/225, 226; 430/138, 332, 336, 337, 338, 350, 348, 334

[56] References Cited

U.S. PATENT DOCUMENTS

| | | | |
|---|---|---|---|
| 4,803,192 | 2/1989 | Saeki et al. | 503/212 |
| 4,929,530 | 5/1990 | Saeki et al. | 430/138 |
| 4,962,009 | 10/1990 | Washizu et al. | 430/138 |
| 4,985,331 | 1/1991 | Saeki et al. | 430/138 |
| 5,389,489 | 2/1995 | Yanagihara et al. | 430/138 |

FOREIGN PATENT DOCUMENTS

| | | | |
|---|---|---|---|
| 3-191341 | 8/1991 | Japan | G03C 1/675 |

OTHER PUBLICATIONS

JP 03–191341 (abstract only) Aug. 1991 (Saeki et al.).
JP 02–143252 (abstract only) Jun. 1990 (Ozawa et al.).

*Primary Examiner*—Martin J. Angebranndt
*Attorney, Agent, or Firm*—Sughrue, Mion, Zinn, Macpeak & Seas

[57] ABSTRACT

An optical image forming material in which the background portions thereof are not color developed (not fogged) during storage in the dark after fixing, comprising a support having thereon at least a coating layer containing (1) microcapsules containing a leuco dye which is form color when it is oxidized and a photooxidizing agent, and (2) a reducing agent and a fixing accelerator present outside of the microcapsules. The reducing agent is a hydroquinone derivative substituted by an alkyl group at each of 2- and 5-positions thereof, and the fixing accelerator is 2,2-bis(4-hydroxyphenyl)propane.

8 Claims, No Drawings

OPTICAL IMAGE FORMING MATERIAL

FIELD OF THE INVENTION

The present invention relates to an optical image forming material which can be used as a proof paper, printout paper, overlay film, etc., and particularly to an optical image forming material of the leuco dye family which can be thermally fixed. More particularly, the present invention relates to an optical image forming material in which color is not developed (fog is not produced) in background portions during storage in the dark after fixing.

BACKGROUND OF THE INVENTION

Heretofore, optical image forming materials for a proof paper, a printout paper, an overlay film, and the like have been used in many photographic applications in the form of free radical photographs in which photosensitive portions are visualized by imagewise exposure.

In this regard, those methods in which various kinds of leuco dyes are color developed by radical oxidation to dyes corresponding thereto using photooxidizing agents are particularly effective. In these methods, color is formed on exposure to usual indoor light, sunlight or white light, even after dye images have been formed by exposure, due to the sensitivity of leuco dyes to light. Thus, several methods have been proposed in which fixing is carried out after image exposure. Of these, an optical image forming material is known in which a leuco dye and a photooxidizing agent are contained together in microcapsules, and a reducing agent is present outside the microcapsules. This arrangement allows the image recording material to be fixed by heat treatment after exposure as described in U.S. Pat. No. 4,962,009. The use of hydroquinone reducing agent is known to improve the storage stability after fixing of this type of optical image forming material, as described in JP-A-3-191341 (the term "JP-A" as used herein means an "unexamined published Japanese patent application"). However, these hydroquinone reducing agents are disadvantageous in background portions become color developed (fogged) during storage in the dark after fixing. This results in a reduction in contrast between images and the background portion (white portion) to thereby deteriorate quality and performance.

On the other hand, low temperature fixing type optical image forming materials have been proposed in which reducing agents are used in combination with compounds which lower the melting point of the reducing agents in order to lower the fixing temperature and decrease the fixing time (U.S. Pat. No. 4,929,530). However, this type of system also does not prevent color development (fogging) of the background portions during storage in the dark after fixing.

SUMMARY OF THE INVENTION

It is therefore an object of the present invention to provide an optical image forming material which can be fixed using methods in which various kinds of leuco dyes are color developed by radical oxidation to dyes corresponding thereto by use of photooxidizing agents, wherein background portions are not color developed (i.e., are not fogged) during storage in the dark after fixing.

The above object of the present invention is achieved by providing an optical image forming material comprising a support having thereon at least a coating layer containing (1) microcapsules containing a leuco dye which forms color when it is oxidized and a photooxidizing agent, and (2) a reducing agent and a fixing accelerator present outside of the microcapsules, in which the reducing agent comprises a hydroquinone derivative substituted by an alkyl group at each of 2- and 5-positions thereof, and the fixing accelerator comprises 2,2-bis(4-hydroxy-phenyl)propane.

DETAILED DESCRIPTION OF THE INVENTION

The hydroquinone derivatives for use in the present invention are represented by the following general formula (1):

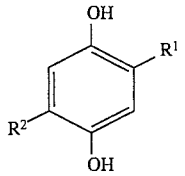

(1)

wherein $R^1$ and $R^2$ each represents an alkyl group, preferably an alkyl group having 1 to 20 carbon atoms, and more preferably an alkyl group having 1 to 10 carbon atoms. Examples thereof include methyl, ethyl, n-butyl, sec-butyl, tert-butyl, n-pentyl, iso-pentyl, tert-pentyl, n-hexyl, tert-hexyl, n-octyl and tert-octyl groups.

The alkyl group represented by $R^1$ and $R^2$ may be substituted with an alkoxy group having 1 to 10 carbon atoms (e.g., methoxy, ethoxy, n-butoxy, iso-butoxy, n-hexyloxy, n-octyloxy), an alkoxycarbonyl group having 2 to 11 carbon atoms (e.g., methoxycarbonyl, ethoxycarbonyl, n-hexyloxycarbonyl), or a halogen atom (e.g., chlorine).

Furthermore, in general formula (1), hydroquinone derivatives in which at least one of $R^1$ and $R^2$ is a tertiary alkyl group are preferred. The tertiary alkyl group represents an alkyl group whose carbon atom to be bonded with the benzene carbon of hydroquinone is bonded to other three carbon atoms.

When at least one of $R^1$ and $R^2$ represents a tertiary alkyl group, a tertiary alkyl group having 4 to 20 carbon atoms is preferred. In particular, a tertiary alkyl group having 4 to 12 carbon atoms is preferred. Examples thereof include tert-butyl, tert-pentyl, tert-hexyl and tert-octyl (1,1,3,3-tetramethylbutyl) groups. Tert-pentyl, tert-hexyl and tert-octyl groups are particularly preferred.

Examples of the compounds represented by general formula (1) which can be used in the present invention include, but are not limited to, 2,5-di-tert-butylhydroquinone, 2,5-di-tert-pentylhydroquinone, 2,5-di-tert-hexylhydroquinone, 2,5-di-tert-octylhydroquinone, 2,5-di-tert-nonylhydroquinone, 2-methyl-5-tert-butylhydroquinone, 2-n-hexyl-5-tert-butylhydroquinone, 2-methyl-5-tert-pentylhydroquinone, 2-methyl-5-tert-hexyl-hydroquinone and 2-methyl-5-tert-octylhydroquinone.

Details of the synthesis method of the hydroquinone derivatives for use in the present invention are described, for example, in JP-A-3-141236.

After fixing the optical image forming material of the present invention, color development (fogging) of the background portions during storage in the dark can be inhibited by a combination of a hydroquinone derivative substituted by an alkyl group at each of 2- and 5-positions, namely, the above-described specific reducing agent, and 2,2-bis(4-hydroxy-phenyl)propane, namely, a specific fixing accelerator.

Details of the synthesis method of the specific fixing accelerator for use in the present invention are described, for example, in JP-A-62-148440 and JP-A-63-23830.

The leuco dyes preferably used in the present invention include, for example, the compounds described in U.S. Pat. No. 3,445,234. Examples thereof are given below.

(A) Aminotriarylmethane, aminoxanthene, aminothioxanthene, amino-9,10-dihydroacridine, aminophenoxazine, aminophenothiazine, aminodihydrophenazine, aminodiphenylmethane and leucoindamine (B) Aminohydrocinnamic acid (cyanoethane), hydrazine, leucoindigoid dyes, amino-2,3-dihydroanthraquinone, tetrahalo-p,p-biphenol, 2-(p-hydroxyphenyl)-4,5-diphenylimidazole and phenethylaniline Of these leuco dyes, type (A) produces a mother dye by losing one hydrogen atom, and type (B) produces a mother dye by losing two hydrogen atoms.

Specific examples thereof include tris(4-dimethylaminophenyl)-methane, tris(4-diethylaminophenyl)-methane, tris(4-diethylamino-2-methylphenyl)methane, bis(4-diethylaminophenyl)-(4-diethylamino-2-methylphenyl) methane, bis(4-diethylamino-2-methylphenyl)-(4-diethylaminophenyl)methane, bis(1-ethyl-2-methylindole-3-yl)phenylmethane, 2-N-(3-trifluoromethylphenyl)-N-ethylamino-6-diethylamino-9-(2-methoxycarbonylphenyl)-xanthene, 2-(2-chlorophenyl)amino-6-dibutylamino-9-(2-methoxycarbonylphenyl)xanthene, 2-dibenzylamino-6-diethylamino-9-(2-methoxycarbonylphenyl) xanthene, benzo[a]-6-N,N-diethylamino-9-(2-methoxycarbonylphenyl)xanthene, 2-(2-chlorophenyl)-amino-6-dibutylamino-9-(2-methylphenylcarboxamidophenyl)xanthene, 3,6-dimethoxy-9-(2-methoxycarbonylphenyl)xanthene, Benzoyl Leucomethylene Blue and 3,7-bis-diethylaminophenoxazine.

Preferred photooxidizing agents for use in the optical image forming material of the present invention are usually inactive, but produce chemical species which oxidize the leuco dyes to form color on exposure to actinic ray such as visible ray, ultraviolet ray, infrared ray and X-ray.

Typical examples of the photooxidizing agents include lophine dimer compounds such as 2,2'-bis(o-chlorophenyl)-4,4',5,5'-tetraphenylbiimidazole, 2,2'-bis(o-trifluoromethylphenyl)-4,4',5,5'-tetraphenylbiimidazole, 2,2'-bis(o-trifluoromethylphenyl)-4,4',5,5'-tetrakis(4-methoxyphenyl)-biimidazole, 2,2'-bis(o-trifluoromethylphenyl)-4,4',5,5'-tetrakis(3,4-methylenedioxyphenyl)biimidazole, 2,2'-bis(o-nitrophenyl)-4,4',5,5'-tetraphenylbiimidazole, 2,2'-bis(2,3-dichlorophenyl)-4,4',5,5'-tetraphenylbiimidazole, 2,2'-bis(2,3-dichlorophenyl)-4,4',5,5'-tetrakis(3-methoxyphenyl)biimidazole and 2,2',5-tris(o-chlorophenyl)-4-(3,4-dimethoxyphenyl)-4',5'-diphenylbiimidazole described in U.S. Pat. Nos. 4,247,618 and 4,252,887; azido compounds such as 2-azidobenzoxazole, benzoyl azide and 2-azidobenzimidazole described in U.S. Pat. No. 3,282,693; pyridinium compounds such as 3'-ethyl-1-methoxy-2-pyridothiacyanin perchlorate and 1-methoxy-2-methylpyridinium p-toluenesulfonate described in U.S. Pat. No. 3,615,568; organic halogen compounds such as N-bromosuccinimide, tribromomethylphenyl sulfone, 2-trichloromethyl-5-(p-butoxystyryl)-1,3,4-oxadiazole and 2,6-ditrichloromethyl-4-(p-methoxyphenyl)-triazine; and azide polymers described in *Summaries of Lectures in the Spring Research Representation Meeting of the Photographic Society of Japan in* 1968, page 55. Of these, the lophine dimer compounds and the organic halogen compounds are preferred, and it is particularly preferred to use both in combination to achieve high sensitivity.

In preparing the optical image forming material of the present invention, the leuco dye and the photooxidizing agent are mixed with each other preferably in a molar ratio of 10:1 to 1:10, and more preferably in a molar ratio of 2:1 to 1:2.

In the present invention, the capsules preferably prevent substances inside the capsules from contacting substances outside the capsules by substance isolation action of walls of the microcapsules at ordinary temperatures, and permeability of these substances increase only when the capsules are heated above a certain temperature. The phrase "at ordinary temperatures" used herein means the temperatures lower than the glass transition temperature of a material of the capsule walls, and the temperature range is generally from 20° to 70° C. The phrase "above a certain temperature" used herein means the temperatures higher than the glass transition temperature of a material of the capsule walls, and the temperature range is generally from 80° to 200° C. In this regard, the permeation initiating temperature of the capsules can be freely controlled by appropriately selecting the wall material and the core material of the capsules and additives. In this case, the permeation initiating temperature corresponds to the glass transition temperature of the walls of the capsules.

In order to control the glass transition temperature of the capsule walls, it is necessary to select an appropriate capsule wall forming agent. The wall materials for use in the present invention include polyurethanes, polyureas, polyamides, polyesters and polycarbonates. Of these, polyurethanes and polyureas are particularly preferred.

The microcapsules for use in the present invention may be prepared by emulsifying a core substance comprising the optical image forming substances containing the leuco dye and the photooxidizing agent, and thereafter forming walls of a polymer material around the resulting emulsified droplets of oil. In this case, a reactant for forming the walls is added to the inside and/or the outside of the droplets of oil.

Details of the preparation method of the microcapsules for use in the present invention are described, for example, in U.S. Pat. Nos. 3,726,804 and 3,796,696, JP-A-62-259111, and JP-A-6-167765.

High boiling oils can be used as organic solvents for dissolving the above-described optical image forming substances. Examples thereof include phosphates, phthalates, acrylates, methacrylates, other carboxylates, fatty acid amides, alkylated biphenyls, alkylated terphenyls, alkylated naphthalenes, diarylethanes and chlorinated paraffins.

In the present invention, low boiling supplementary solvents may be added to the above-described organic solvents. Examples of the supplementary solvents include ethyl acetate, isopropyl acetate, butyl acetate, methylene chloride and cyclohexanone.

In order to prepare the emulsified oil droplets in a stable manner, a protective colloid or a surface active agent can be added to the aqueous phase. A water-soluble polymer can generally be used as the protective colloid.

In the present invention, the volume average grain size of the microcapsules is preferably from 0.1 μm to 20 μm, and more preferably from 0.3 μm to 4 μm, to improve image resolution and ease of handling.

In the optical image forming material of the present invention, an antioxidant can be added to the core material of the microcapsules, in order to impart enhanced stability before use. Useful antioxidants include phenol compounds, hydroquinone compounds, catechol compounds and aniline compounds. Specific examples thereof include 2,6-di-t-butyl-4-methylphenol, 2,4,6-tri-t-butylphenol, 2,5-di-t-butylhydroquinone, 2,3-di-t-butylhydroquinone, 2,5-di-t-octylhydroquinone, 2,5-di-t-amylhydroquinone, 3,6-di-t-butylcatechol, N,N-dioctylaniline, N,N-dimethyl-p-toluidine, N,N-dibutyl-m-toluidine, N,N-diethyl-m-phenetidine, N,N-diethylamino-m-octyloxybenzene, 6-ethoxy-1,2,3,4-tetrahydro-2,2,4-trimethylquinoline, 1,2-bis(m-dimethylaminophenoxy)-ethane, 1,2-bis(m-diethylaminophenoxy)ethane and 1,3-bis(m-diethylaminophenoxy)propane.

In producing the optical image forming material of the present invention, the photooxidizing agent and the antioxidant are mixed preferably in a molar ratio of 10:0.001 to 10:2, and more preferably in a molar ratio of 10:0.01 to 10:1.

In the present invention, the hydroquinone derivative and 2,2-bis(4-hydroxy-phenyl)propane are preferably solid dispersed in a sand mill, etc. or dissolved in an oil for emulsion dispersion, to thereby add the same to the optical image forming material of the present invention. In solid dispersion or emulsion dispersion, a protective colloid is preferably used.

The hydroquinone derivative of the present invention is used in an amount of from 1 to 100 mols per mol of the photooxidizing agent component, and more preferably from 2 to 20 mols per mol of the photooxidizing agent component.

The 2,2-bis(4-hydroxy-phenyl)propane of the present invention is used in an amount of from 0.5 to 20 mols per mol of the hydroquinone derivative, and more preferably from 1 to 10 mols per mol of the hydroquinone derivative.

Images in the present invention are effectively fixed by contacting the photooxidizing agent with the reducing agent through the walls of the capsules by heating as described above.

The optical image forming material of the present invention can be produced by applying a dispersion of (1) the microcapsules containing the leuco dye and the photooxidizing agent, and (2) the reducing agent and the fixing accelerator to form an optical image forming layer on the support.

A binder, a pigment, a wax, a metal soap, a melting point lowering agent or a surface active agent may be added to the above-described dispersion of (1) the microcapsules containing the leuco dye and the photooxidizing agent and (2) the reducing agent and the fixing accelerator. The amount of the dispersion applied to the support for forming the optical image forming layer of the present invention is preferably from 2 to 30 g/m$^2$ in terms of its solid component, and more preferably 3 to 20 g/m$^2$.

Materials suitable for the support include paper from tissue paper to thick cardboard, regenerated cellulose, cellulose acetate, cellulose nitrate, polyethylene terephthalate, polyethylene, polyvinyl acetate, polymethyl methacrylate and polyvinyl chloride.

Methods for coating the support include, but are not limited to, air knife coating, curtain coating, slide coating, roller coating, dip coating, wire bar coating, blade coating, gravure coating, spin coating and extrusion coating.

Furthermore, an subbing layer may be formed on the support, or a covering layer may be formed on the optical image forming layer, as needed. The subbing layer and the covering layer generally contain binders and/or pigments as the main components thereof.

In the present invention, the light source can be used for activation of the photooxidizing agent and image formation of the leuco dye is not particularly limited. Conventional light sources include fluorescent lamps, mercury lamps, metal halide lamps, xenon lamps and tungsten lamps.

The present invention is described in more detail in the examples shown below. However, the invention should not be construed as being limited thereto. All the parts and percents are by weight unless otherwise specified.

EXAMPLE 1

One part of tris(4-dimethylaminophenyl)methane, 2.4 parts of tris(4-diethylamino-2-methylphenyl)methane, 6.6 parts of 2,2'-bis(o-chlorophenyl)-4,4',5,5'-tetraphenylbiimidazole, 1.3 parts of tribromomethylphenyl sulfone and 33 parts of a 75% ethyl acetate solution of a xylylene diisocyanate/trimethylol-propane adduct were dissolved in a mixed solvent of 53 parts of ethyl acetate and 33 parts of trixylenyl phosphate. The resulting solution was added to 213 parts of a 5% aqueous solution of carboxy-modified polyvinyl alcohol, and dispersed by emulsification at 20° C. to obtain an emulsified solution having an average grain size of 1 μm. To the resulting emulsified solution, 88 parts of water was added, and stirring was continued at 50° C. for 3 hours. Then, the temperature was lowered to room temperature, and the solution was filtered to obtain a capsule dispersion. The solid content of this dispersion was 25.0%.

Then, 10 parts of 2,5-di-tert-octylhydroquinone and 16 parts of 2,2-bis(4-hydroxyphenyl)propane were added to 65 parts of a 6% aqueous solution of carboxy-modified polyvinyl alcohol and dispersed in a horizontal sand mill to obtain a reducing agent-containing dispersion having an average grain size of 1 μm.

Then, a coating solution having the following composition was prepared.

| | |
|---|---|
| Capsule Dispersion Described Above (25%) | 100 parts |
| Hydroquinone-Bisphenol Dispersion Described Above | 75 parts |
| 20% Silica (SYLOID 404, Manufactured by Fuji Davison Chemical Ltd.) Dispersion | 10 parts |
| 30% Epoxidized Polyamide Resin (FL-71, Manufactured by Toho Kagaku Co.) | 5 parts |
| 10% Aqueous Solution of 4-Methylpentyl Sulfosuccinate | 5 parts |

This coating solution was applied to a sheet of woodfree paper (basis weight: 76 g/m$^2$) with a coating rod so as to provide an applied solid amount of 6 g/m$^2$, and dried at 50° C. to obtain an optical image forming material.

EXAMPLE 2

An optical image forming material was obtained in the same manner as in Example 1, except that 10 parts of 2,5-di-tert-hexylhydroquinone was substituted for the 10 parts of 2,5-di-tert-octylhydroquinone.

EXAMPLE 3

An optical image forming material was obtained in the same manner as in Example 1, except that 10 parts of 2,5-di-tert-pentylhydroquinone was substituted for the 10 parts of 2,5-di-tert-octylhydroquinone.

COMPARATIVE EXAMPLE 1

An optical image forming material was obtained in the same manner as in Example 1, except that a reducing agent-containing dispersion was prepared without addition of 16 parts of 2,2-bis(4-hydroxyphenyl)propane.

COMPARATIVE EXAMPLE 2

An optical image forming material was obtained in the same manner as in Example 1, except that 10 parts of hydroquinone was substituted for the 10 parts of 2,5-di-tert-octylhydroquinone, and the reducing agent-containing dispersion was prepared without addition of 16 parts of 2,2-bis(4-hydroxyphenyl)propane.

COMPARATIVE EXAMPLE 3

An optical image forming material was obtained in the same manner as in Example 1, except that 10 parts of 2-tert-octylhydroquinone was substituted for the 10 parts of 2,5-di-tert-octylhydroquinone.

COMPARATIVE EXAMPLE 4

An optical image forming material was obtained in the same manner as in Example 1, except that 10 parts of hydroquinone was substituted for the 10 parts of 2,5-di-tert-octylhydroquinone.

COMPARATIVE EXAMPLE 5

An optical image forming material was obtained in the same manner as in Example 1, except that 16 parts of p-xylylenediol was substituted for the 16 parts of 2,2-bis(4-hydroxyphenyl)propane.

COMPARATIVE EXAMPLE 6

An optical image forming material was obtained in the same manner as in Example 1, except that 16 parts of p-toluenesulfonamide was substituted for the 16 parts of 2,2-bis(4-hydroxyphenyl)propane.

COMPARATIVE EXAMPLE 7

An optical image forming material was obtained in the same manner as in Example 1, except that 16 parts of p-benzyloxyphenol was substituted for the 16 parts of 2,2-bis(4-hydroxyphenyl)propane.

The optical image forming materials obtained in Examples 1 to 3 and Comparative Examples 1 to 7 were evaluated as follows:

(1) Image Density and Background Density Immediately after Fixing

A fresh sample was irradiated with light through a line drawing manuscript using a jet light (an extra-high pressure mercury lamp, manufactured by Oak Inc.) to obtain a blue image. Then, the sample was passed through a heating roller at 120° C. at a rate of 450 mm/minute to fix the unexposed portions. Also, the image density of an exposed portion and the background density of an unexposed portion were measured with a Macbeth reflection densitometer.

(2) Fixing Property

The sample processed by method (1) described above was stored for 8 hours in a room illuminated at 800 luxes. Then, the background density of an unexposed portion was measured with a Macbeth reflection densitometer. A background density of the unexposed portion after storage (2) that is higher than the background density prior to storage (1) indicates a poor fixing property.

(3) Image Density after Raw Storage (Raw Storage Quality of Material)

A freshly prepared sample was stored in the dark under conditions of 45° C. and 30% RH for 1 week, and the developed color density of an exposed portion was measured with a Macbeth reflection densitometer. A low developed color density indicates a low raw storage quality.

(4) Storage Stability in the Dark of Background Portions

The sample prepared by method (1) described above was stored in the dark at 30° C. for 1 month and for 3 months. Then, the density of a background portion was measured with a Macbeth reflection densitometer to compare with the background density measured immediately after fixing. A background density after storage in the dark that is higher than that immediately after fixing indicates poor storage stability in the dark.

The results are shown in Table 1.

TABLE 1

| | Image Density | Background* Density (1) | Background* Density (2) | Image Density after Raw Storage | Background* Density (4) | Background* Density (4') |
|---|---|---|---|---|---|---|
| Example 1 | 1.06 | 0.04 | 0.04 | 1.06 | 0.05 | 0.05 |
| Example 2 | 1.05 | 0.05 | 0.05 | 1.04 | 0.05 | 0.05 |
| Example 3 | 1.05 | 0.04 | 0.05 | 1.04 | 0.05 | 0.05 |
| Comparative Example 1 | 1.03 | 0.05 | 0.75 | 1.03 | 0.12 | 0.48 |
| Comparative Example 2 | 1.05 | 0.05 | 1.02 | 1.04 | 0.23 | 0.55 |
| Comparative Example 3 | 1.08 | 0.04 | 0.90 | 1.05 | 0.24 | 0.52 |
| Comparative Example 4 | 1.06 | 0.05 | 1.05 | 1.05 | 0.30 | 0.56 |
| Comparative Example 5 | 1.04 | 0.04 | 1.04 | 1.04 | 0.25 | 0.53 |
| Comparative Example 6 | 1.04 | 0.05 | 0.05 | 0.66 | 0.15 | 0.28 |
| Comparative Example 7 | 1.04 | 0.05 | 0.05 | 0.35 | 0.09 | 0.19 |

Remarks:
Background density (1) to (4') each represents the results under following condition.
(1) immediately after fixing
(2) after storage for 8 hours in a room illuminated at 800 luxes
(4) after storage for 1 month at 30° C. in the dark
(4') after storage for 3 month at 30° C. in the dark As shown in Table 1, the use of a hydroquinone derivative each substituted by an alkyl group at each of 2- and 5-positions as the reducing agent, together with 2,2-bis(4-hydroxy-phenyl)propane as the fixing accelerator provides an optical image forming material of the present invention satisfying characteristics (1) to (3) described above which are essential characteristics of an optical image forming material. Furthermore, the optical image forming material of the present invention satisfies characteristic (4) in that the background portions are not color developed (not fogged) during storage in the dark after fixing.

While the invention has been described in detail and with reference to specific examples, it will be apparent to one skilled in the art that various changes and modifications can be made without departing from the spirit and scope thereof.

What is claimed is:

1. An optical image forming material comprising a support having thereon at least a coating layer containing (1) microcapsules containing a leuco dye which forms color when it is oxidized and a photooxidizing agent, and (2) a reducing agent and a fixing accelerator present outside of said microcapsules, wherein said reducing agent comprises a hydroquinone compound substituted by an alkyl group at each of 2- and 5-positions thereon, and said fixing accelerator comprises 2,2-bis(4-hydroxy-phenyl)propane;

wherein said hydroquinone compound is represented by general formula (1):

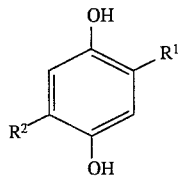

(1)

wherein $R^1$ and $R^2$ each represents an alkyl group.

2. The optical image forming material of claim 1, wherein said alkyl group represented by $R^1$ and $R^2$ is an alkyl group having from 1 to 20 carbon atoms.

3. The optical image forming material of claim 1, wherein one or both of $R^1$ and $R^2$ is a tertiary alkyl group having from 4 to 20 carbon atoms.

4. The optical image forming material of claim 1, wherein said microcapsules contain the leuco dye and the photooxidizing agent in a molar ratio of from 10:1 to 1:10.

5. The optical image forming material of claim 1, wherein said microcapsules have a size of from 0.1 μm to 20 μm.

6. The optical image forming material of claim 1, wherein said microcapsules further contain an antioxidant.

7. The optical image forming material of claim 1, wherein the hydroquinone compound is contained in an amount of from 1 to 100 mols per mol of the photooxidizing agent.

8. The optical image forming material of claim 1, wherein the 2,2-bis(4-hydroxy-phenyl)propane is contained in an amount of from 4.5 to 20 mols per mol of the hydroquinone compound.

* * * * *